United States Patent [19]

Teumer et al.

[11] Patent Number: 4,493,483

[45] Date of Patent: Jan. 15, 1985

[54] INVERTER-REVERSER FOR A REPRODUCTION MACHINE

[75] Inventors: Roger G. Teumer, Fairport; David M. Attridge, Rochester, both of N.Y.

[73] Assignee: Xerox Corporation, Stamford, Conn.

[21] Appl. No.: 7,862

[22] Filed: Jan. 31, 1979

[51] Int. Cl.[3] ..... B65H 29/00

[52] U.S. Cl. ..... 271/186; 271/65; 271/DIG. 9

[58] Field of Search ..... 221/184, 186, 188, 189, 221/209, DIG. 9, 185, 65, 275, 304, 21, 22, 23, 34

[56] References Cited

U.S. PATENT DOCUMENTS 2,901,246 8/1959 Wagner .
3,856,295 12/1974 Looney ..... 271/65
3,951,402 4/1976 Skinner ..... 271/275
4,025,187 5/1977 Taylor et al. ..... 271/34

*Primary Examiner*—Bruce H. Stoner, Jr.
*Attorney, Agent, or Firm*—Bernard A. Chiama

[57] ABSTRACT

A reproduction machine adapted for producing copies of an original on both sides of a copy sheet and forwarding the finished copy to a collator. An inverter-reverser is employed which allows single-sided copy to a waiting station for subsequent processing to allow copying on the reverse side of the sheet to produce duplex copies, and for inverting duplex copies prior to delivery to the collator to provide the required sheet orientation in the collator. A sheet buckle control device cooperates with the inverter-reverser to insure that papers of widely different paper sizes, weights and stiffness will be inverted during the inverting stage of delivery of duplex copies.

1 Claim, 4 Drawing Figures

INVERTER-REVERSER FOR A REPRODUCTION MACHINE

Figure 1:
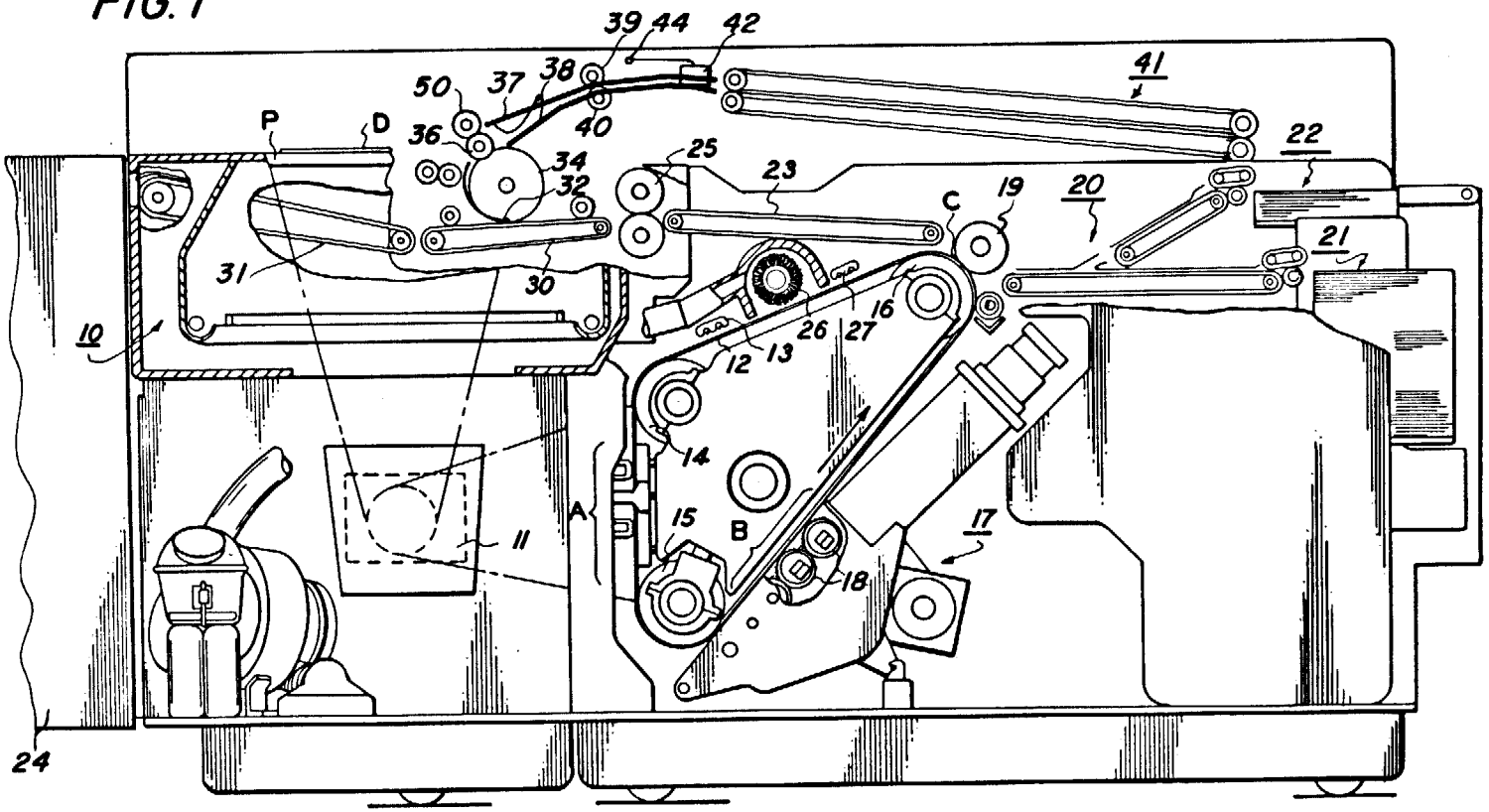

In recent years a number of high volume, high speed electrostatic reproduction machines have been introduced. To cope with the large quantities of copies produced, collators of the type illustrated in U.S. Pat. No. 3,830,590 issued Aug. 20, 1974, commonly assigned with the instant application, have been introduced for collating the copies to minimize operator involvement with the copying process.

It was soon after this that the need for a reproduction machine which would reproduce on both sides of a sheet of paper, ordinarily referred to as duplex copying was recognized. Duplex copying, however, presents a number of problems in a copy reproduction system in that the machine must be capable of routing singlesided copy sheets directly to the collator, must be adapted for returning single-sided copy sheets to a paper waiting station in preparation for copying on the opposite side of the sheet to produce duplex copies, and must be adapted to invert the duplex copy to provide the proper orientation thereof prior to passage to the collator if the correct page order is to be maintained. These capabilities are adapted to be accomplished by the apparatus described in U.S. Pat. No. 3,856,295, commonly assigned with the instant application, and to which the instant invention is an improvement.

Card inverting mechanisms of the type illustrated in U.S. Pat. No. 2,901,246 and sheet inverting mechanism of the type illustrated in U.S. Pat. No. 3,523,687 are well known in the art. However, the known inverters are unacceptable for use in a high speed reproduction system adapted for producing copies on sheet material of the type normally encountered in a copy reproduction machine. These machines are ordinarily capable of handling a wide range of paper weights: from the ultra-light 16 lbs. weight to the relatively stiff card-like 110 lb. weight.

At the high speeds encountered, an inverter-reverser must include guide means capable of positively directing lightweight paper as well as stiff paper in proper orientation thereby insuring many cycles of operation without failure. For heavyweight paper, the device must also be capable of coping with the high inertial forces necessary for inverting the sheets at high speed. Further, since a wide variety of paper stock may be encountered, the device must be capable of handling sheets having fairly large size tolerances. In the above referred to U.S. Pat. No. 3,856,295, the range of paper weights and sizes usable in the disclosed apparatus is somewhat limited. The present invention is a modification to that disclosed apparatus which extends to a wider range the paper weights and sizes which can be utilized.

It is therefore an object of this invention to extend the range of paper weights and sizes in apparatus handling single-sided or double-sided copy sheets while enroute to a collator and to accomplish this activity with utmost efficiency.

This invention is utilized in a reproduction system having a copy reproduction machine and a collator, and suitable transport means to direct single-sided copy through a first path to the collator deflector means being provided to intercept single-sided copies prior to passage to the collator, to deflect the copies through a second path to a location wherefrom the sheets are refed through the reproduction machine to provide duplex copies, the deflector being adapted to intercept the duplex copy for passage through a portion of the second path, means being provided in the second path for contact with the lead edge of the copy sheet to stop passage thereof, feed means being adapted for contact with the trailing edge of the intercepted sheet to feed the paper in the reverse direction to the collator for collation therein.

Figure 2:
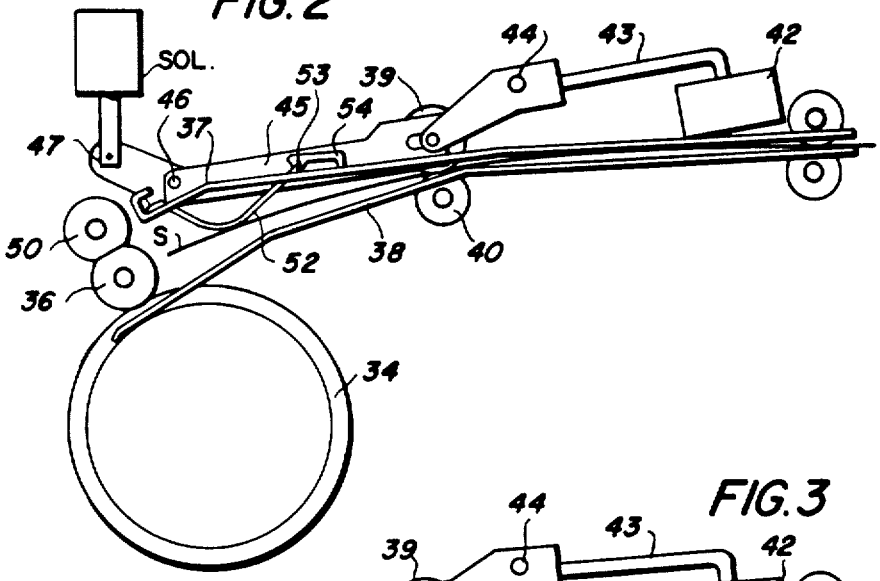
Figure 3:
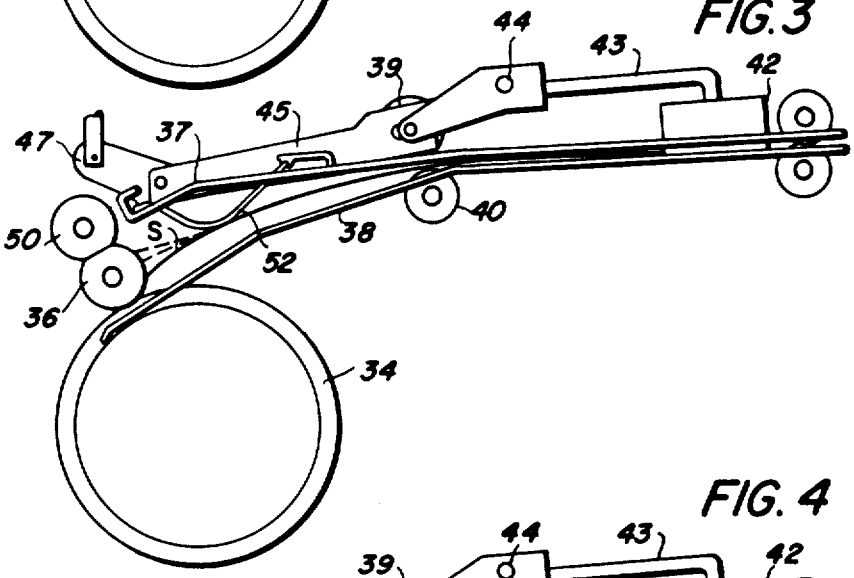
Figure 4:
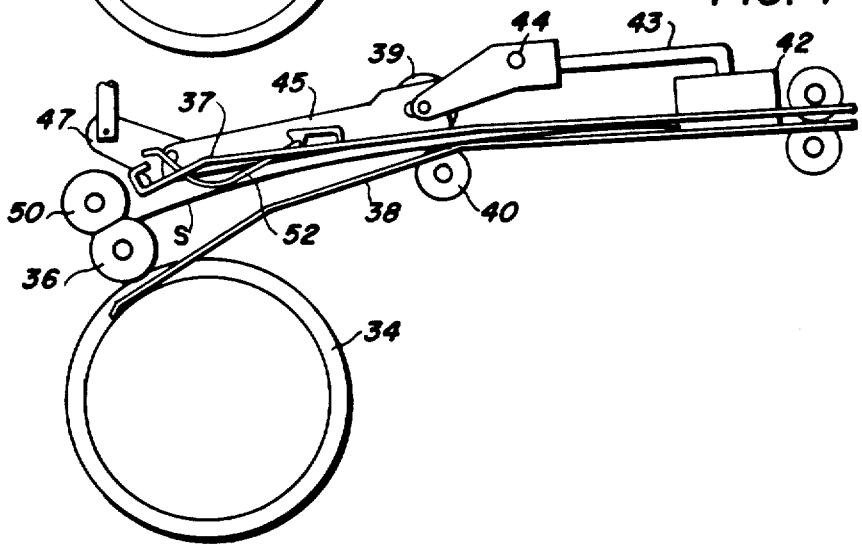

Other objects and advantages may be apparent from the following description of the preferred embodiment of the invention taken in conjunction with the accompanying drawings in which:

FIG. 1 is a schematic representation of an electrostatic reproduction system including an electrostatic reproduction processor and a collator;

FIG. 2 is a schematic view of the inverter-reverser mechanism employed with the reproduction system of FIG. 1 illustrating a first position of the various components thereof to allow sheets to pass to the collator for collation therein; and FIGS. 3 and 4 are schematic illustrations of the inverter-reverser mechanism illustrating a second position of the various components thereof to allow lightweight copy sheets on the order of 16# and 20# and heavyweight paper or card stock on the order of up to 110#, respectively to pass to the collator.

For a general understanding of an electrostatic processing system in which the invention may be incorporated, reference is made to FIG. 1. In the illustrated machine, an original D to be copied is placed upon a transparent support platen P fixedly arranged in an illumination assembly generally indicated by the reference numeral 10. While upon the platen, an illumination system flashes light rays upon the original thereby producing image rays corresponding to the information areas on the original. The image rays are projected by means of an optical system 11 to an exposure station A for exposing the photosensitive surface of a moving xerographic plate in the form of a flexible photoconductive belt 12. In moving in the direction indicated by the arrow, prior to reaching exposure station A, that portion of the belt being exposed would have been uniformly charged by a corona device 13 located at the belt run extending between belt supporting rollers 14 and 16. The exposure station extends between the roller 14 and a third support roller 15.

The exposure of the belt surface to the light image discharges the photoconductive layer in the areas struck by light, whereby there remains on the belt a latent electrostatic image in image configuration corresponding to the light image projected form the original on the supporting platen. As the belt surface continues its movement, the electrostatic image passes around the roller 15 and through a developing station B located at a third run of the belt wherein there is provided a developing apparatus generally indicated by the reference numeral 17. The developing apparatus 17 comprises a plurality of brushes 18, which carry developing material to the adjacent surface of the upwardly moving inclined photoconductive belt 12 in order to provide development of the electrostatic image.

The developed electrostatic image is transported by the belt 12 to a transfer station C located at a point of tangency on the belt as it moves around the roller 16 whereat a sheet of copy paper is moved at a speed in synchronism with the moving belt in order to accomplish transfer of the developed image. There is provided at this station a transfer roller 19, which is arranged on the frame of the machine for contacting the non-transfer side of each sheet of copy paper as the same is brought into transfer engagement with the belt 12. The roller 19 is electrically biased with sufficient voltage so that a developed image on the belt 12 may be electrostatically transferred to the adjacent side of a sheet of paper as the same is brought into contact therewith. There is also provided a suitable sheet transport mechanism 20 adapted to transport sheets of paper seriatim from a paper sheet handling mechanism 21 or a waiting station 22 in the form of another sheet handling mechanism to the developed image on the belt as the same is carried around the roller 16. A programming device operatively connected to the mechanisms 21, 22 and the illumination device for producing an electrostatic latent image on the belt 12, is effective to present a developed image at the transfer station C in timed sequence with the arrival of a sheet of paper.

The sheet is stripped from the belt 12 after transfer of the image thereto by a stripper transport 23 and thereafter conveyed by the stripper transport into a fuser assembly generally indicated by the reference numeral 25 wherein the developed and transferred xerographic powder image on the sheet is permanently affixed thereto. After fusing, the copy is either discharged from the reproduction machine into the collator 24 or routed back to the waiting station 22 in a manner to be hereinafter described. The toner particles remaining as residue on the developed image, background particles, and those particles otherwise not transferred are carried by the belt 12 to a cleaning apparatus positioned on the run of the belt between rollers 14 and 16 adjacent the charging device 13. The cleaning device, comprising a rotating brush 26 and a corona emission device 27 for neutralizing charges remaining on the particles, is connected to a vacuum source (not shown) for removing the neutralized toner particles from the belt prior to the formation of subsequent images thereon.

Referring now to FIG. 2, there is illustrated an inverter-reverser mechanism adapted to receive copy sheets after images thereon have been fixed by the fuser 25 and route the fused copies to the waiting station or sheet handling mechanism 22.

The inverter-reverser mechanism cooperates with a first transport 30 adapted to receive fused copies from the fuser for transport to the collator. When the reproduction system is being utilized to produce one-sided copy, the sheets from the fuser are transported by transport 30 directly to the collator 24 by way of another transport 31. When double-sided or duplex copies are to be produced, copies on the transport 30 are intercepted by a deflector 32 which is adapted for movement into the sheet path as illustrated in FIGS. 2 and 3. With the deflector 32 in the intercept position, the sheets, illustrated by the reference letter S are carried around a feed roll 34 and through the nip formed by the roll 34 and a cooperating roll 36. The sheet is advanced by rolls 34, 36 between an upper sheet guide baffle 37 and a lower sheet guide baffle 38 to a second feed roll pair consisting of a pressure roll 39 and a drive roll 40 which further advance the sheet to a transport mechanism 41 (see FIG. 1) which carries the sheet to the waiting station 22. When the desired number of one-sided copies have been produced and delivered to the station 22, the paper handling mechanism 21 may be inactivated and the paper handling mechanism in the waiting station 22 activated. It should be understood that in following the paper path around roller 34 and between feed roll pair 39, 40, the copy sheets are turned over, i.e., the printed material is on the top of the sheets in the waiting station.

Upon re-energization of the machine, the sheets from paper handling mechanism for the waiting station 22 are fed by means of the transport 20 through the reproduction machine once again for copying on the blank side of the sheet in the same manner as described heretofore. Now, since the second side of the copy sheet carries the second page of the duplexed copies, that is, page 2 of a document having pages 1 and 2 thereon, there is need for returning the duplexed copies in proper orientation to the collator 24. This is accomplished by the inverter-reverser mechanism presently to be described.

Upon activation of the machine for producing the duplex copy, a sheet stop 42 is lowered into the paper path between the upper guide baffle 37 and the lower, guide baffle 38 by means of a suitable solenoid SOL. The stop 42 is secured to one end of a lever 43 mounted for pivotal motion at 44 and which supports the upper pressure roller 39 at the other end. In this manner, when the stop 42 is in the inoperative, upper position as shown in FIG. 2, the pressure roll 39 is in contact with the drive roll 40 for conveying sheets to the transport 41. When the stop 42 is lowered to its operative position, as shown in FIG. 3, the pressure roll 39 is raised out of contact with the roll 40 in order not to be involved in the movement of sheets into and out of the inverter. The pressure roll 39 may be raised and lowered by a crank arm 45 pivoted at 46 and secured to a link 47 which is suitably connected to the solenoid mentioned above. Activation of this solenoid serves to raise and lower the roll 39 and the stop 42.

The sheet stop 42 is formed of a resilient material such as a doughnut or ring shaped, flexible, polyurethane foam having a very low local and bulk spring rate. The foam ring does not damage light paper and is compliant enough to accept a large mass range (6.0:1) adequate length range (approximately one half inch variation in sheet length) without adjustment. Recovery of the foam ring to its circular shape is used to insert the sheet into the nip formed between roll 36 and a cooperating roll 50, the trailing edge of the sheet being carried by roll 36 into the nip. The rolls 36 and 50 are formed of a high friction material such as polyurethane foam to assure positive feeding of a sheet traveling toward stop 42 and positive feeding of the sheet traveling away from stop 42 against the drag force generated between two sheets which may be in the inverter area at the same time traveling in opposite directions.

It has been found that with very lightweight paper, say on the order of 16# and 20#, the deflection stop 42 may damage the leading edge if driven too far into the stop since the stop is close enough to the roll 36. Since the inverter-reverser must be such as to accommodate different sizes of sheet width, say 8 inches to 8½ inches without adjusting the structure therefor, the present invention is directed to forming a controlled buckle for a fairly wide range of paper sheet sizes. To this end one or more hinged wire deflector elements 52 are mounted on a pivot 53 held in a bracket 54 secured to the guide 37 adjacent the widened space between the guides 37, 38. The deflectors are properly weighted to control the formation of paper buckle in a manner such that proper stubbing of the lead edge of a sheet will occur on the roll 36, and that the primary buckle will form slightly back of contact with the deflectors.

The deflector elements 52 shown in FIG. 3 are pivotally supported to allow limited pivotal movement from its lowermost position shown in FIG. 3 to its uppermost position shown in FIG. 4. The elements are properly weighted to exceed the bending force required for 16# and 20# paper and to increase the normal force of the sheet against the roll 36 during stubbing. Control of the formation of a buckle is also enhanced by the shape of the guides 37, 38 and by the relatively narrow spacing between the guides adjacent the stop 42 which stiffens the sheet at this end and guides the same into the center of the stop. The shape and spacings of the guides keep each sheet straight as they contact the stop thereby utilizing the maximum beam strength of the sheet and forcing the buckle to occur in a controlled area between the rolls 39, 40 and the deflectors 52.

When heavy paper or card stock, up to 110# is used, it is not desirable to buckle the paper to any extent and the deflector elements are light enough to be pushed out of the paper path by the paper and still direct the trailing edge of the sheet into the nip of the rolls 36, 50, as shown in FIG. 4.

From the foregoing, it will be appreciated that the present invention extends the usefulness of a dynamic paper inverter-reverser by extending to a wider range the paper weights and sizes utilizable in a copying machine. It will also be appreciated that this feature can be accomplished without varying or modifying other structures of inverter-reverser. While there is described a preferred embodiment of the invention, it is to be understood that the invention is not limited thereto but may be otherwise embodied within the scope of the following claims.

What is claimed is:

1. In a sheet handling apparatus for a reproduction apparatus arranged for two-sided copying having an arrangement for inverting a sheet to prepare the same for receiving an image on a second side thereof wherein the arrangement includes first and second feed rolls forming a first feed roll pair having a nip for moving a sheet in one direction and a third feed roll forming a second feed roll pair with the second roll having a nip for moving a sheet in the opposite direction, and a resilient stop means against which a sheet moving in said one direction contacts to deflect the same and effect the edge of the sheet opposite the stop means to be engaged by the second roll and be directed into the nip of the second feed roll pair, the improvement comprising:

means movable into and out of the path of movement of a sheet of paper as the same is guided toward the second feed roll pair for controlling formation of a buckle on the sheet between said movable means and the stop means as the edge of the sheet opposite the stop means is carried around the second roll and into the feed nip of the secod roll pair, said movable means is weighted to form a relatively large buckle for very lightweight sheets and to form a very shallow buckle for sheets of heavyweight paper.

* * * * *